US005383264A

United States Patent [19]

Gardaz et al.

[11] Patent Number: 5,383,264

[45] Date of Patent: Jan. 24, 1995

[54] PROCESS FOR THE APPLICATION OF A FLUOROCARBONATED RESIN BASE COATING TO A FLAT METALLIC SUPPORT

[75] Inventors: Claudine Gardaz, Rumilly; Jean-Pierre Buffard, Tresserve, both of France

[73] Assignee: SEB S.A., Selongey, France

[21] Appl. No.: 38,692

[22] Filed: Mar. 29, 1993

[30] Foreign Application Priority Data

Mar. 27, 1992 [FR] France ..... 92 03730

[51] Int. Cl.[6] ..... B05D 5/08

[52] U.S. Cl. ..... 29/527.2; 29/557; 427/275; 427/277; 427/282; 427/287; 427/292; 427/388.1

[58] Field of Search ..... 427/282, 287, 388.1, 427/275, 277, 292; 29/527.2, 557

[56] References Cited

U.S. PATENT DOCUMENTS 5,202,162 4/1993 Hart et al. ..... 427/282

FOREIGN PATENT DOCUMENTS 63-089185 4/1988 Japan .
3-217470 9/1991 Japan .
788791 1/1958 United Kingdom .
WO91/05022 4/1991 WIPO .

*Primary Examiner*—Janyce Bell
*Attorney, Agent, or Firm*—Young & Thompson

[57] ABSTRACT

The process permits applying a fluorocarbonated resin base coating on a flat metallic support (4). According to the invention, this coating is applied in a continuous manner, directly on the support (4) by serigraphy. Use particularly to coat cooking utensils with a layer of fluorocarbonated resin. (See FIG. 2).

6 Claims, 1 Drawing Sheet

PROCESS FOR THE APPLICATION OF A FLUOROCARBONATED RESIN BASE COATING TO A FLAT METALLIC SUPPORT

The present invention relates to a process for the application of a fluorocarbon resin base coating to a flat metallic support, adapted particularly after baking the coating to be stamped in the form of a cooking receptacle.

The process most often used to apply a fluorocarbon resin coating such as polytetrafluoroethylene, consists. pulverizing on the flat support having preliminarily been subjected to chemical attack, an aqueous dispersion of fluorocarbon resin particles.

The coating thus obtained adheres perfectly to the metallic support thanks particularly to the microcavities formed on this latter by the chemical attack.

However the process by pulverization presents the drawback of giving rise to a loss of fluorocarbon resin of at least 50% and a pollution of the environment.

Another process consists in applying the coating on the flat support by means of a roller that calendars on a paste of fluorocarbon resin base.

This technique permits reducing the waste of fluorocarbonated resin, but does not permit obtaining a high quality coating. Thus, the coating obtained is not perfectly smooth, but has undulations because of the passage of the roller. Because of this, the coating is sensitive to cracking.

The object of the present invention is to overcome the drawbacks of the previously-known processes, by providing a process which permits both obtaining a smooth coating, perfectly adhering to the metallic support, and giving rise to no loss or pollution of the environment.

According to the invention, the process for the application of a fluorocarbon resin base coating on the flat metallic support is characterized in that this coating is applied in a continuous manner directly on the support by serigraphy.

According to this process, there is used to apply the coating a serigraphic screen whose portion comprising the meshes has a contour which is superposed to the external contour of the flat metallic support.

There is known from European patent 0188958 in the name of the applicant a process for producing a decoration on a fluorocarbon resin coating, in which a base composition of fluorocarbonated resin is applied to a metallic support through the meshes of a serigraphic screen. This serigraphic screen of course includes a mask corresponding to the design which it is desired to reproduce.

Contrary to the process described in the above French patent, the process envisioned by the present invention is not a decoration on a fluorocarbon resin coating which has already been baked, but provides a continuous coating directly on the metallic support.

Tests have shown that such a coating adheres perfectly to the metallic support first subjected to a chemical attack, as in the known prior art. Such a result can be explained by hindsight by the fact that the screed used to apply the coating through the meshes of the serigraphic screen forces the fluorocarbon resin particles to penetrate the microcavities of the flat metallic support, which permits obtaining after baking a perfect adherence of the coating.

Furthermore, the effect of the screed permits obtaining a coating which is perfectly smooth and of uniform and controllable thickness.

Moreover, the process according to the invention permits avoiding any loss of fluorocarbonated resin, because this latter is applied solely to the surface of the support and not externally of this latter.

BRIEF DESCRIPTION OF THE DRAWINGS

Other features and advantages of the invention will become apparent from the following description.

In the accompanying drawing given by way of non-limiting example.

Figure 1:
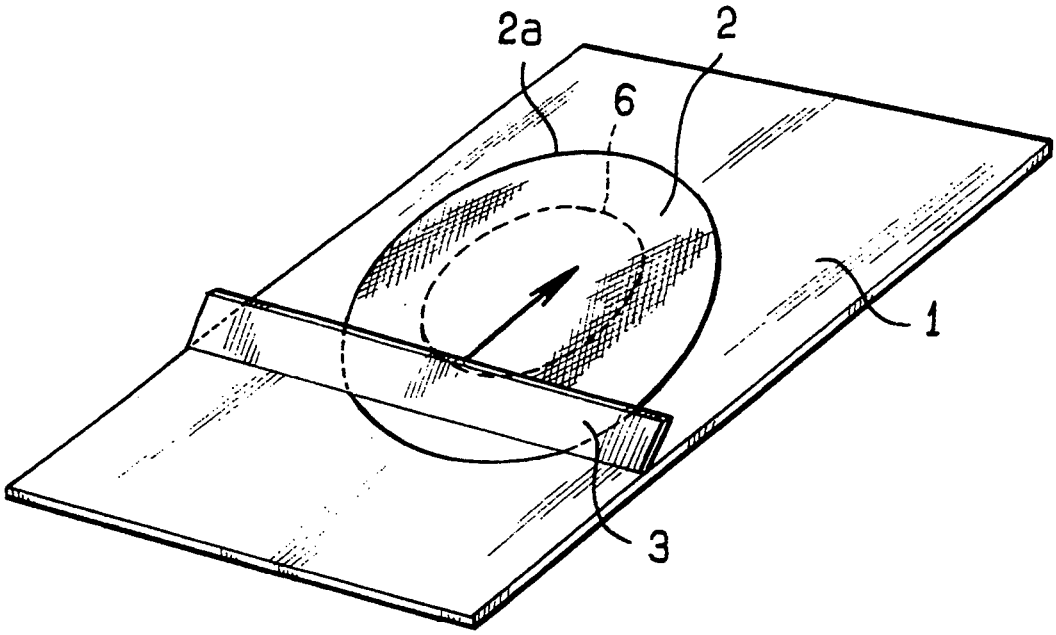
FIG. 1 is a perspective view of a serigraphic screen used in the practice of the process according to the invention.

The serigraphic screen shown in FIG. 1 comprises a plate 1 having in its central portion a circular region 2 comprising meshes, constituted by a stainless steel or polyester grill with very fine meshes, whose openings are for example comprised between 50 and 200 μm.

On this plate 1 can move in the direction of the arrow F a screed 3 for example of polyurethane elastomer.

Figure 2:
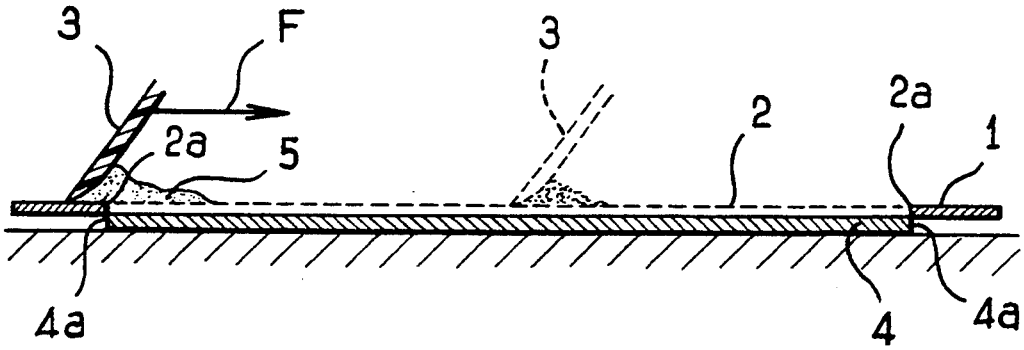
FIG. 2 is a longitudinal cross-sectional view of the serigraphic screen in position on the metallic support.

In accordance with the process according to the invention, the serigraphic screen 1 is disposed as indicated in FIG. 2, above a metallic support 4, constituted for example by a disc of aluminum, having first been subjected to chemical attack.

The circular margin 2*a* of the region 2 comprising the screen meshes corresponds exactly to the circular margin 4*a* of the support 4 in the shape of a disc.

The region 2 comprising the meshes is free from any mask and extends several tens of microns above the surface of the metallic support 4.

To apply a fluorocarbonated resin coating on the support 4, one proceeds as follows:

One places on the screen 1 a fluorocarbonated resin base composition, for example comprised by an aqueous dispersion of polytetrafluoroethylene admixed with a thickening agent to obtain a paste having a certain viscosity, with added materials (for example mica flakes) and pigments.

The screed 3 is moved over the region 2 comprising the meshes, to spread the pasty composition 5 and to force this latter through the meshes of the screen. The pasty composition 5 is thus deposited on the surface of the support, forming on this latter a continuous coating of uniform thickness in a moist condition, comprised between 5 and 30 μm per layer.

During application of the coating, no material is lost and the environment is neither dirtied nor polluted.

After baking at 400°–420° C., the coating obtained is perfectly smooth, uniform, of constant thickness and has excellent adherence to the support.

The thickening agent used during practice of the process of serigraphic application can be selected for example from the group consisting of acrylic or methacrylic polymers, bentonites, polysaccharides, alginates, carboxymethylcelluloses and guar gum.

Examples of formulation of the fluorocarbonated resin composition used in the process according to the invention are described in European patent 0188958.

The disc coated serigraphically obtained according to the process in accordance with the invention can be stamped into the form of a cooking receptacle.

Ordinarily, one eliminates the fluorocarbonated resin coating from the region of the external surface of the bottom of the receptacle, that is to say the region adapted to be exposed to heat.

This elimination also represents a loss of primary material and energy and gives rise to supplemental pollution.

This drawback can be avoided thanks to the process according to the invention, by providing on the grill 2 of the serigraphic screen 1, a mask 6 (shown in broken lines in FIG. 1) covering a central region of the grill 2, corresponding to the external surface of the bottom of the receptacle to be stamped. Thanks to this mask 6, the portion of the disc 3 corresponding to the bottom described above, will not be clad with fluorocarbon resin during practice of the process of serigraphic application.

Of course, the invention is not limited to the examples which have been described and one can bring to these numerous modifications without departing from the scope of the invention.

Thus, the process can also be used to the serigraphic coating of an aluminum support preliminarily sandblasted, to which one applies one or two primary bonding layers then one or several finishing layers.

We claim:

1. A process for the application of a fluorocarbonated resin base coating to a flat metallic support, which comprises applying by serigraphy an aqueous dispersion of polytetrafluoroethylene admixed with a thickening agent in a form of a paste as a continuous coating on a flat metallic support in the shape of a disc, hardening said aqueous dispersion on said disc, and thereafter stamping the disc to the form of a cooking receptacle.

2. Process according to claim 1, characterized in that one uses to apply the coating, a serigraphic screen whose portion comprising meshes has a shape which superposes on an external contour of the flat metallic support.

3. Process according to claim 2, characterized in that the serigraphic screen is totally free from a mask over its portion comprising the meshes.

4. Process according to claim 2, characterized in that the serigraphic screen is totally free from a mask over its portion comprising the meshes, except a central region of this latter.

5. Process according to claim 1, in which there is used a serigraphic screen having a central masked region corresponding to the outer surface of the bottom of a cooking receptacle to be stamped from the support.

6. Process according to claim 1, characterized in that one applies on the metallic support a mixture of fluorocarbonated resin in the form of a dispersion, a thickener, fillers and pigments.

* * * * *